US009477198B2

(12) United States Patent
Hayashi

(10) Patent No.: US 9,477,198 B2
(45) Date of Patent: Oct. 25, 2016

(54) CLEANING DEVICE AND ELECTROPHOTOGRAPHIC IMAGE FORMING APPARATUS HAVING THE SAME

(71) Applicant: SAMSUNG ELECTRONICS CO., LTD., Suwon-si (KR)

(72) Inventor: Shigeki Hayashi, Yokohama (JP)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/724,944

(22) Filed: May 29, 2015

(65) Prior Publication Data

US 2016/0062303 A1 Mar. 3, 2016

(30) Foreign Application Priority Data

Sep. 3, 2014 (JP) ..... 2014-179465
Jan. 30, 2015 (KR) ..... 10-2015-0015585

(51) Int. Cl.
*G03G 21/00* (2006.01)

(52) U.S. Cl.
CPC ..... *G03G 21/0011* (2013.01); *G03G 21/0029* (2013.01)

(58) Field of Classification Search
CPC ..... G03G 21/0029; G03G 2221/1618; G03G 2221/1648
See application file for complete search history.

(56) References Cited

U.S. PATENT DOCUMENTS

2014/0086618 A1* 3/2014 Shimizu ..... G03G 21/0029 399/102

FOREIGN PATENT DOCUMENTS

| | | | |
|---|---|---|---|
| JP | 5165376 | A | 7/1993 |
| JP | 10-301458 | A | 11/1998 |
| JP | 11-237818 | A | 8/1999 |
| JP | 200151563 | A | 2/2001 |
| JP | 2001-249591 | A | 9/2001 |
| JP | 200291254 | A | 3/2002 |
| JP | 2002-229405 | A | 8/2002 |
| JP | 200584136 | A | 3/2005 |
| JP | 2005-266318 | A | 9/2005 |
| JP | 2006184429 | A | 7/2006 |
| JP | 2007108384 | A | 4/2007 |
| JP | 2008-299064 | A | 12/2008 |
| JP | 2014-126744 | A | 7/2014 |

OTHER PUBLICATIONS

Communication issued on Jan. 27, 2016 by the European Patent Office in counterpart European Application No. 15173351.6.
Communication issued on Sep. 10, 2015 by the International Searching Authority in related Application No. PCT/KR2015/005526, (PCT/ISA/210 & PCT/ISA/237).

* cited by examiner

*Primary Examiner* — Gregory H Curran
(74) *Attorney, Agent, or Firm* — Staas & Halsey LLP

(57) ABSTRACT

A cleaning device configured to remove a developing agent from a photosensitive body, and an electrophotographic image forming apparatus including the cleaning device, are provided. The cleaning device includes a cleaning blade assembly including a cleaning blade configured to remove the developing agent, and a support plate configured to support the cleaning blade. The cleaning device further includes a housing portion configured to support the cleaning blade assembly. The cleaning device further includes a scattering prevention portion configured to prevent the developing agent from leaking through a gap between an end of the cleaning blade and the housing portion in a lengthwise direction, extend in the lengthwise direction over the end of the cleaning blade, and connect the cleaning blade assembly to the housing portion.

25 Claims, 16 Drawing Sheets

CLEANING DEVICE AND ELECTROPHOTOGRAPHIC IMAGE FORMING APPARATUS HAVING THE SAME

CROSS-REFERENCE TO RELATED APPLICATIONS

This application claims priority from Japanese Patent Application No. 2014-179465, filed on Sep. 3, 2014, in the Japanese Patent Office, and Korean Patent Application No. 10-2015-0015585, filed on Jan. 30, 2015, in the Korean Intellectual Property Office, the disclosures of which are incorporated herein by reference in their entireties.

BACKGROUND

1. Field

Apparatuses and methods consistent with exemplary embodiments relate to a cleaning device and an electrophotographic image forming apparatus having the cleaning device.

2. Description of the Related Art

An operation of laser printers includes a charging process of charging the entire surface of a photosensitive body, an exposure process of forming an electrostatic latent image on the photosensitive body by radiating laser beams onto the photosensitive body, a developing process of forming a visible image by attaching a developing agent to the electrostatic latent image, a transfer process of transferring the visible image onto paper, and a fusing process of fusing the visible image transferred onto the paper on the paper. In the transfer process, the whole developing agent is not transferred onto the paper, and the developing agent remains in the photosensitive body. The residual developing agent lowers printing quality of a next page, and thus needs to be removed. A cleaning device for cleaning the surface of the photosensitive body is disposed as a device for removing the residual developing agent. Also, when a two-component developing agent including carriers and toner is used as the developing agent, the toner is attached onto the photosensitive body by performing the developing process. However, a small number of carriers may be attached onto the photosensitive body. In this case, the cleaning device cleans the stuck matter. Thus, the stuck matter to be cleaned by the cleaning device is toner, and may include carriers.

A method of scratching and removing the residual developing agent on the surface of the photosensitive body using a cleaning blade configured of an elastic member, as the cleaning device, is used. The removed residual developing agent is recovered by a recovering mechanism, such as an auger screw disposed in the cleaning device. The developing agent including very small particles may float and leak into a fine gap. Because leakage of the developing agent may cause contamination or failure in an image forming apparatus, this needs to be prevented. In order to prevent the leakage of the residual developing agent, a sealing structure is employed in a needed position of the cleaning device, and sealing members are installed in both ends of the cleaning blade.

In a structure for preventing leakage of the developing agent through a space between both ends of the cleaning blade and a housing portion, a sealing member is installed between an end of the cleaning blade and the housing portion to fill a gap between both ends of the cleaning blade and the housing portion. In a structure in which lateral ends of the sealing member and lateral ends of the cleaning blade come into contact with each other, it is not easy to maintain high adhesion performance therebetween. Also, when an oscillating cleaning blade that oscillates in a direction of a diameter or an axial direction of the photosensitive body is employed, the elasticity of the sealing member is insufficient so that the sealing member may not follow the oscillation of the cleaning blade, or an elastic force of the sealing member is lowered due to deterioration according to time, and thus the sealing member may not follow the oscillation of the cleaning blade.

SUMMARY

Exemplary embodiments address at least the above problems and/or disadvantages and other disadvantages not described above. Also, the exemplary embodiments are not required to overcome the disadvantages described above, and may not overcome any of the problems described above.

Exemplary embodiments provide cleaning devices that may more effectively prevent a developing agent from leaking from an end of a cleaning blade as cleaning devices for removing a residual developing agent on a photosensitive body, and elecrophotographic image forming apparatuses having the cleaning devices.

According to an aspect of an exemplary embodiment, there is provided a cleaning device configured to remove a developing agent from a photosensitive body, the cleaning device including a cleaning blade assembly including a cleaning blade configured to remove the developing agent, and a support plate configured to support the cleaning blade. The cleaning device further includes a housing portion configured to support the cleaning blade assembly, and a scattering prevention portion configured to prevent the developing agent from leaking through a gap between an end of the cleaning blade and the housing portion in a lengthwise direction, extend in the lengthwise direction over the end of the cleaning blade, and connect the cleaning blade assembly to the housing portion.

The scattering prevention portion may include a first scattering prevention portion disposed in the cleaning blade assembly, and a second scattering prevention portion disposed in the housing portion. One of the first scattering prevention portion and the second scattering prevention portion may include an extension portion configured to extend in the lengthwise direction over the end of the cleaning blade, and another one of the first scattering prevention portion and the second scattering prevention portion may include an accommodation portion configure to accommodate the extension portion.

The other one of the first scattering prevention portion and the second scattering prevention portion may include an elastic member.

The first scattering prevention portion may include a film member, the film member including the extension portion configured to extend toward the housing portion over the end of the cleaning blade. The second scattering prevention portion may include a first sealing member and a second sealing member configured to overlap each other, and the accommodation portion disposed between the first sealing member and the second sealing member.

The extension portion may be disposed between the first sealing member and the second sealing member.

The second scattering prevention portion may include a frictional contact member configured to overlap the second sealing member, and frictionally contact the photosensitive body.

The cleaning blade may be disposed on a first surface of the support plate, and the film member may be disposed on a second surface of the support plate that is opposite to the first surface.

The first scattering prevention portion may include an elastic absorption member disposed between the cleaning blade and the film member, the elastic absorption member configured to absorb elasticity of the film member that affects a contact force of the cleaning blade with respect to the photosensitive body.

The elastic absorption member may be attached to the film member.

The second scattering prevention portion may include a film member, the film member including the extension portion configured to extend toward the cleaning blade assembly over the end of the cleaning blade. The first scattering prevention portion may include an elastic member attached to the cleaning blade assembly, and the accommodation portion disposed between the cleaning blade assembly and the elastic member.

The elastic member may be attached to the support plate, and the accommodation portion may be disposed between the elastic member and the support plate.

The first scattering prevention portion may be disposed at a position lower than a contact point between the photosensitive body and the cleaning blade.

The scattering prevention portion may include a film member attached to the cleaning blade assembly, the film member including an extension portion configured to extend toward the housing portion over the end of the cleaning blade. The extension portion may be connected to the housing portion.

The scattering prevention portion may include a sealing member attached to the housing portion and the extension portion.

The cleaning blade may be configured to oscillate in either one or both of a diameter direction of the photosensitive body and an axial direction parallel to a rotation axis of the photosensitive body.

According to an aspect of an exemplary embodiment, there is provided an electrophotographic image forming apparatus including a photosensitive body on which an electrostatic latent image is formed, a developing portion configured to attach a developing agent onto the electrostatic latent image to develop a toner image, a transferring portion configured to transfer the toner image onto a recording medium, and a cleaning device configured to remove a developing agent that remains on the photosensitive body after the transferring. The cleaning device includes a cleaning blade assembly including a cleaning blade configured to remove the developing agent, and a support plate configured to support the cleaning blade. The cleaning device further includes a housing portion configured to support the cleaning blade assembly, and a scattering prevention portion configured to prevent the developing agent from leaking through a gap between an end of the cleaning blade and the housing portion in a lengthwise direction, extend in the lengthwise direction over the end of the cleaning blade, and connect the cleaning blade assembly to the housing portion.

According to an aspect of an exemplary embodiment, there is provided a cleaning device configured to remove a developing agent from a photosensitive body, the cleaning device including a blade configured to trace a contour of the photosensitive body to remove the developing agent from the photosensitive body, a plate disposed on the blade, a housing, and a film member configured to connect the plate to the housing as the blade traces the contour of the photosensitive body.

The cleaning device may further include a first elastic member disposed on the housing, and a second elastic member disposed on the first elastic member. The film member may be disposed on the plate and between the first elastic member and the second elastic member.

The cleaning device may further include a contact member disposed on the second elastic member, the contact member including a first portion configured to contact the blade, and a second portion configured to contact the photosensitive body.

The cleaning device may further include an elastic member disposed on the plate. The film member may be disposed on the housing and between the plate and the elastic member.

The cleaning device may further include a contact member disposed on the housing, the contact member configured to contact the photosensitive body.

The cleaning device may further include an elastic member disposed on the housing. The film member may be disposed between the plate and the elastic member.

BRIEF DESCRIPTION OF THE DRAWINGS

The above and/or other aspects will be more apparent by describing certain exemplary embodiments with reference to the accompanying drawings in which.

DETAILED DESCRIPTION OF THE EXEMPLARY EMBODIMENTS

Figure 1A:
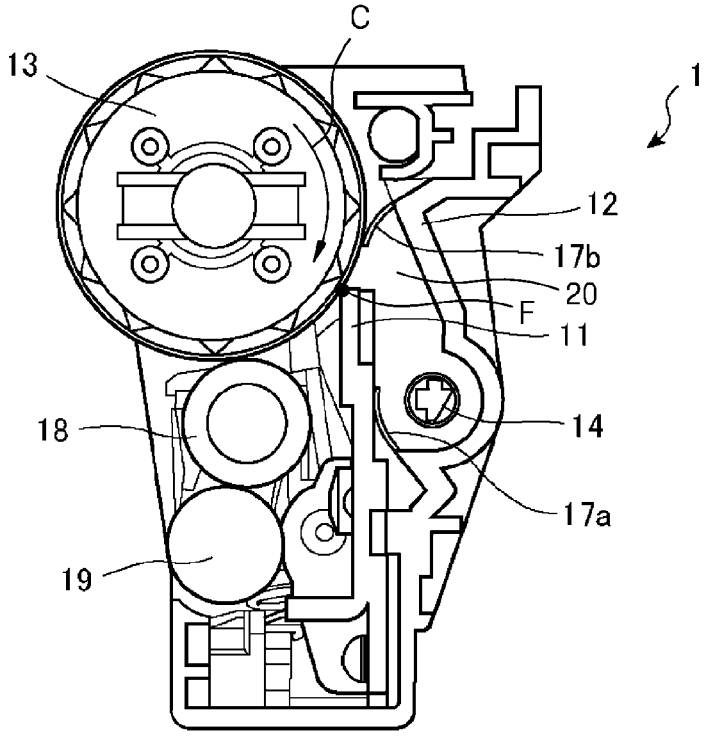
FIG. 1A is a cross-sectional view of a drum portion including a cleaning device according to a first exemplary embodiment.

Exemplary embodiments are described in greater detail herein with reference to the accompanying drawings.

In the following description, like drawing reference numerals are used for like elements, even in different drawings. The matters defined in the description, such as detailed construction and elements, are provided to assist in a comprehensive understanding of the exemplary embodiments. However, it is apparent that the exemplary embodiments can be practiced without those specifically defined matters. Also, well-known functions or constructions are not described in detail because they would obscure the description with unnecessary detail.

It will be understood that the terms "comprises" and/or "comprising" used herein specify the presence of stated features or components, but do not preclude the presence or addition of one or more other features or components. In addition, the terms such as "unit", "-er (-or)", and "module" described in the specification refer to an element for performing at least one function or operation, and may be implemented in hardware, software, or the combination of hardware and software.

Figure 1B:
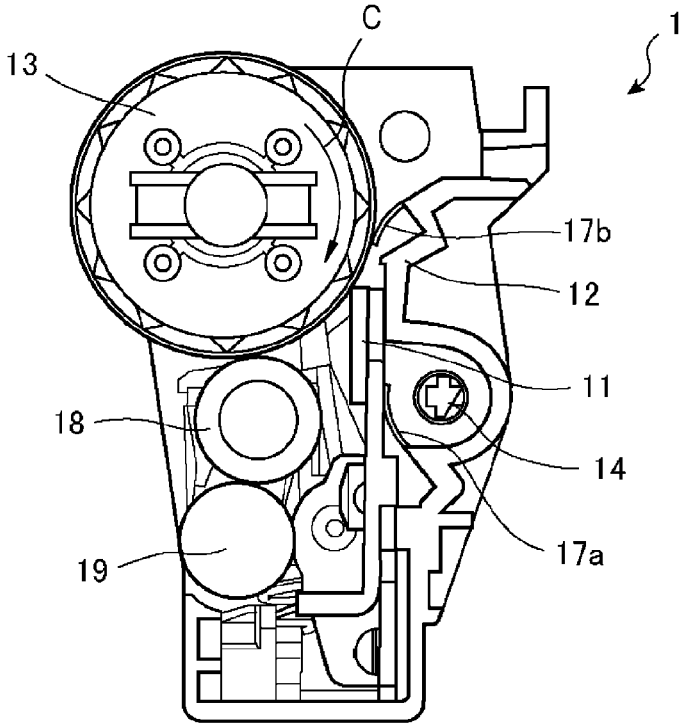
FIG. 1B is a another cross-sectional view of the drum portion including the cleaning device according to the first exemplary embodiment.
Figure 2:
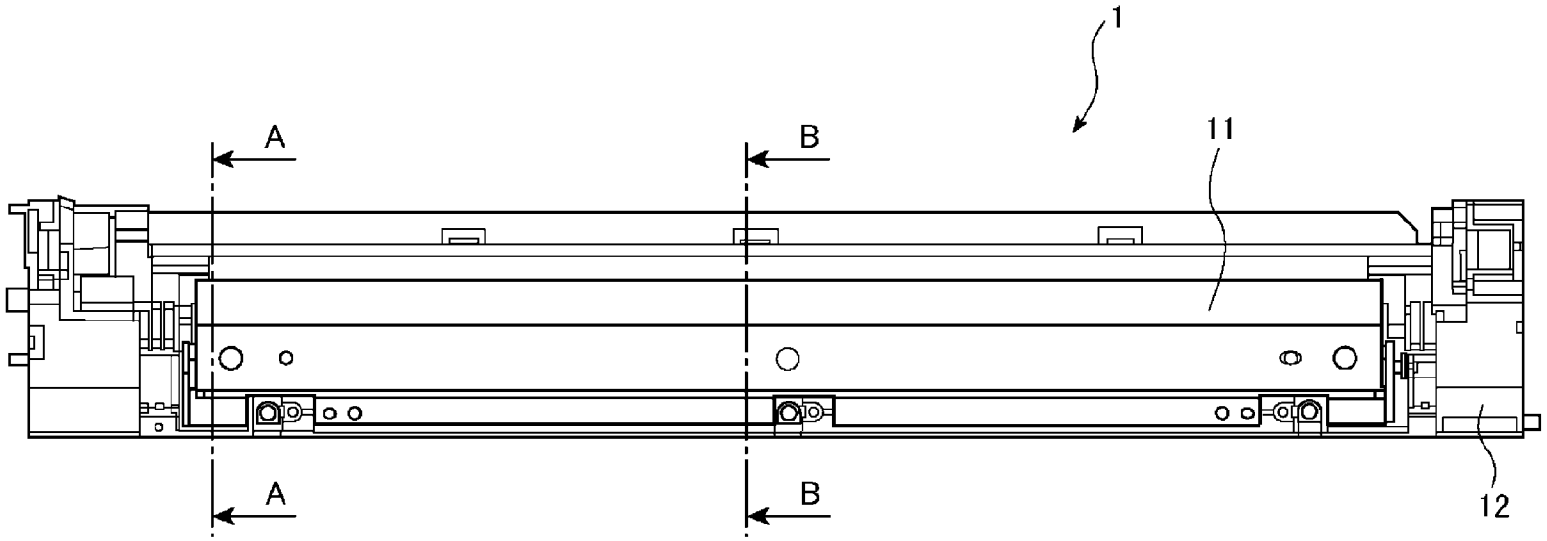
FIG. 2 is a front view illustrating a state in which a cleaning blade assembly is installed at a housing portion of the drum portion according to the first exemplary embodiment.

FIGS. 1A and 1B are cross-sectional views of a drum portion 1 including a cleaning device according to a first exemplary embodiment, and FIG. 2 is a front view illustrating a state in which a cleaning blade assembly 11 is installed at a housing portion 12 of the drum portion 1 according to the first exemplary embodiment. In detail, FIG. 1A is a cross-sectional view taken along line B-B of FIG. 2, and FIG. 1B is another cross-sectional view taken along line A-A of FIG. 2.

As illustrated in FIGS. 1A and 1B, the drum portion 1 includes a photosensitive body 13, a charging roller 18, a cleaning roller 19 that cleans the charging roller 18, the cleaning blade assembly 11, the housing portion 12, a back film member including a lower back film member 17*a* and an upper back film member 17*b*, and an auger screw 14 that is a residual developing agent recovering mechanism.

As illustrated in FIG. 1A, the cleaning blade assembly 11 contacts the photosensitive body 13, and removes the residual developing agent on the photosensitive body 13. The removed residual developing agent is fed back to a front of the drawing due to the auger screw 14, and is recovered. A closed space 20 is formed by the housing portion 12, the photosensitive body 13, the cleaning blade assembly 11, the upper back film member 17*b*, and the lower back film member 17*a*. While the developing agent is removed and then recovered, the residual developing agent is accommodated in the closed space 20 to prevent the residual developing agent from scattering and penetrating other portions of the cleaning device.

Figure 3A:
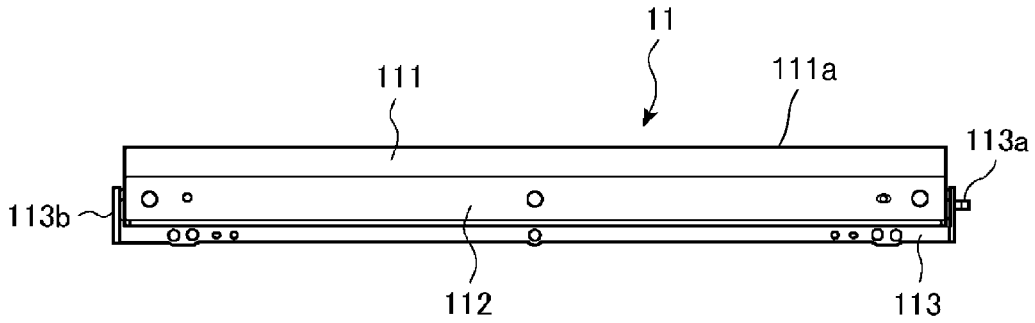
FIG. 3A is a front view of the cleaning blade assembly of the cleaning device according to the first exemplary embodiment.
Figure 3B:
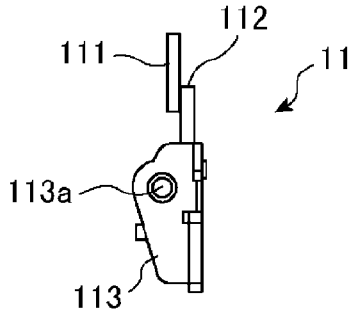
FIG. 3B is a side view of the cleaning blade assembly of the cleaning device according to the first exemplary embodiment.

FIGS. 3A and 3B are views of the cleaning blade assembly 11 of the cleaning device according to the first exemplary embodiment. In detail, FIG. 3A is a front view of the cleaning blade assembly 11, and FIG. 3B is a side view of the cleaning blade assembly 11.

As illustrated in FIGS. 3A and 3B, the cleaning blade assembly 11 includes a cleaning blade 111 that contacts the photosensitive body 13 and removes the residual developing agent, a support plate 112 that supports the cleaning blade 111, and a support member 113 that supports the support plate 112. The cleaning device is a counter-type cleaning device in which the cleaning blade 111 is disposed to face a rotation direction C of the photosensitive body 13, as illustrated in FIG. 1A. That is, a front end 111*a* of the cleaning blade 111 is directed in an opposite direction to the rotation direction C of the photosensitive body 13.

The support member 113 is mounted in the cleaning blade assembly 11 to oscillate with respect to the housing portion 12. Thus, the cleaning blade 111 is supported at the housing portion 12 to oscillate with respect to the photosensitive body 13. At least a part of the cleaning blade assembly 11, for example, the cleaning blade 111, is formed of an elastic member, thereby effectively removing the residual developing agent while following a surface of the photosensitive body 13.

For example, the cleaning blade 111 may oscillate in a direction of a diameter of the photosensitive body 13. For example, an axial portion 113*a* disposed on an end of the support member 113 is supported to be pivotable around the housing portion 12 so the cleaning blade 111 may oscillate in the direction of the diameter of the photosensitive body 13 when the axial portion 113*a* is used as a central axis. A hole 113*b* into which an axial portion disposed in the housing portion 12 is inserted, is disposed in another end of the support member 113. Thus, the cleaning blade 111 may oscillate in the diameter direction of the photosensitive body 13 when the axial portion 113*a* disposed in the support member 113 and the axial portion disposed in the housing portion 12 are used as central axes.

The cleaning device includes a developing agent scattering prevention portion that prevents the developing agent from leaking through a gap between an end of the cleaning blade 111 and the housing portion 12 in a lengthwise direction. The developing agent scattering prevention portion extends in the lengthwise direction of the cleaning blade 111 over an end of the cleaning blade 111, and connects the cleaning blade assembly 11 and the housing portion 12 together. The developing agent scattering prevention portion includes a first developing agent scattering prevention portion 15 and a second developing agent scattering prevention portion 16, as will be shown in and described with respect to FIGS. 4A, 4B, 5A, 5B, and 6.

Figure 4A:
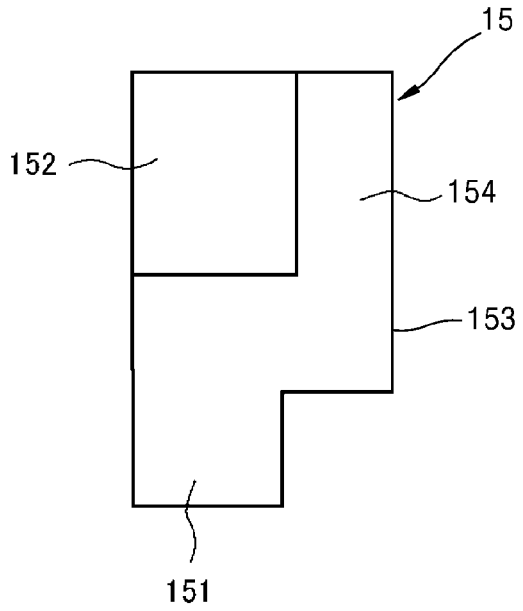
FIG. 4A is a front view of a first developing agent scattering prevention portion of the cleaning device according to the first exemplary embodiment.
Figure 4B:
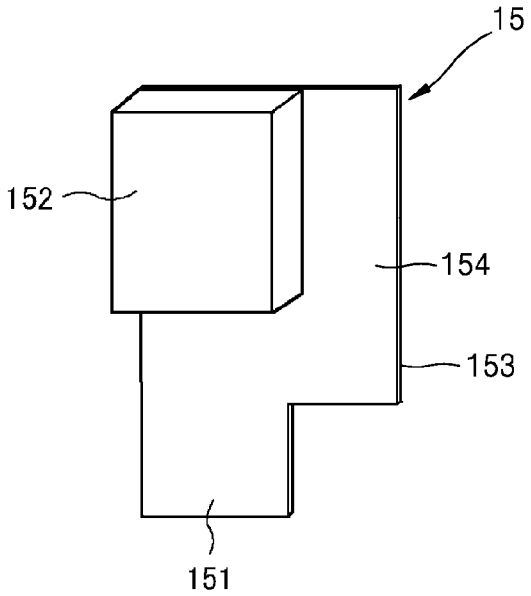
FIG. 4B is a perspective view of the first developing agent scattering prevention portion of the cleaning device according to the first exemplary embodiment.

FIGS. 4A and 4B are views of the first developing agent scattering prevention portion 15 of the cleaning device according to the first exemplary embodiment. In detail, FIG. 4A is a front view of the first developing agent scattering prevention portion 15, and FIG. 4B is a perspective view of the first developing agent scattering prevention portion 15.

The first developing agent scattering prevention portion 15 includes a film member 153 including an attaching portion 151 attached to the support plate 112 of the cleaning blade assembly 11, and an extension portion 154, as will be described below.

Figure 5A:
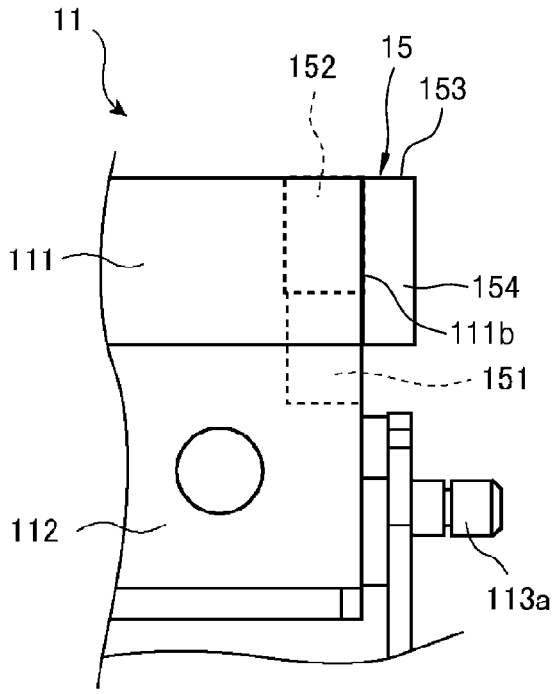
FIG. 5A is a front view illustrating a state in which the first developing agent scattering prevention portion is attached to the cleaning blade assembly of the cleaning device according to the first exemplary embodiment.
Figure 5B:
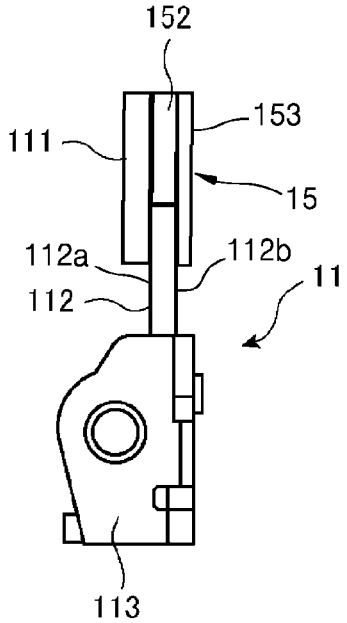
FIG. 5B is a side view illustrating the state in which the first developing agent scattering prevention portion is attached to the cleaning blade assembly of the cleaning device according to the first exemplary embodiment.

FIGS. 5A and 5B are views illustrating a state in which the first developing agent scattering prevention portion 15 is attached to the cleaning blade assembly 11 of the cleaning device according to the first exemplary embodiment. In detail, FIG. 5A is a front view of the state, and FIG. 5B is a side view of the state. Also, FIG. 5A illustrates a right end of the cleaning blade assembly 11, and a left end of the cleaning blade assembly 11 may have the same shape as that of the right end of the cleaning blade assembly 11.

As illustrated in FIGS. 5A and 5B, the attaching portion 151 of the first developing agent scattering prevention portion 15 is attached to the support plate 112. The cleaning blade 111 is attached to contact a surface of the support plate 112, for example, a surface 112*a*, and the attaching portion 151 of the first developing agent scattering prevention portion 15 is attached to a rear surface 112*b* that is opposite to the surface 112*a* of the support plate 112. The surface 112*a* is directed toward the photosensitive body 13. The extension portion 154 of the film member 153 protrudes from a right end 111*b* of the cleaning blade 111 outward. That is, the extension portion 154 extends toward the housing portion 12 over the right end 111*b* of the cleaning blade 111.

Because the film member 153 having the attaching portion 151 is employed, the attaching portion 151 of the film member 153 is attached to the support plate 112 so that the film member 153 may be coupled to the cleaning blade assembly 11. That is, the film member 153 is not directly attached to the cleaning blade 111. Thus, an effect of the film member 153 on a contact force of the cleaning blade 111 with respect to the photosensitive body 13 may be suppressed.

Referring back to FIGS. 4A and 4B, the first developing agent scattering prevention portion 15 further includes a third sealing member (elastic absorption member) 152 attached to the film member 153. The third sealing member 152 may have an approximately rectangular parallelepiped shape. The third sealing member 152 is formed of an elastic member, such as a sponge. For example, the third sealing member 152 may be formed of a closed-cell foam sponge.

Referring again to FIGS. 5A and 5B, a space between the film member 153 of the first developing agent scattering prevention portion 15 and the cleaning blade 111, i.e., a space formed between the cleaning blade 111 and the film member 153 according to a thickness of the support plate 112, is filled with the third sealing member 152. Because the third sealing member 152 is interposed between the film member 153 and the cleaning blade 111, and the third sealing member 152 is formed of an elastic member, an effect of elasticity of the film member 153 with respect to the cleaning blade 111 may be absorbed by the third sealing member 152.

Figure 6:
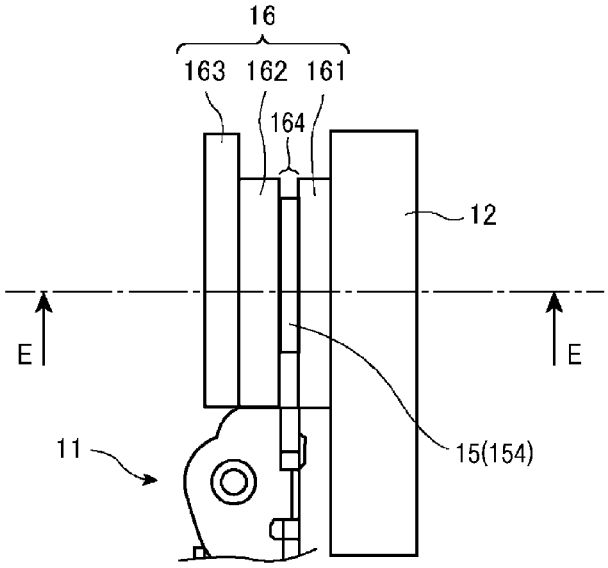
FIG. 6 is a side view of a mutual position relationship between the first developing agent scattering prevention portion and a second developing agent scattering prevention portion of the cleaning device according to the first exemplary embodiment.

FIG. 6 is a side view illustrating a mutual position relationship between the first developing agent scattering prevention portion 15 and the second developing agent scattering prevention portion 16 of the cleaning device according to the first exemplary embodiment.

The second developing agent scattering prevention portion 16 includes a first sealing member 161 attached to the housing portion 12, a second sealing member 162, and a frictional contact member 163 that frictionally contacts the photosensitive body 13.

For example, each of the first sealing member 161 and the second sealing member 162 may be formed of a closed-cell foam sponge that is an elastic member, and the frictional contact member 163 may be formed of a felt material that is non-woven fabric. As illustrated in FIG. 6, the cleaning device has a structure in which at least a part of the first developing agent scattering prevention portion 15 is inserted into the second developing agent scattering prevention portion 16, i.e., a structure in which the first developing agent scattering prevention portion 15 is inserted between the first sealing member 161 and the frictional contact member 163 with the second sealing member 162. That is, the second developing agent scattering prevention portion 16 includes an accommodation portion 164 formed between the first sealing member 161 and the second sealing member 162, and that accommodates at least a part of the first developing agent scattering prevention portion 15. In the first exemplary embodiment, the extension portion 154 that extends over the end 111*b* of the cleaning blade 111 is inserted into the accommodation portion 164.

Subsequently, an example of a process of forming a structure in which at least a part of the first developing agent scattering prevention portion 15 illustrated in FIG. 6 is inserted into the second developing agent scattering prevention portion 16 will be described with reference to FIGS. 7A through 7F.

FIGS. 7A through 7F are views illustrating a process of manufacturing elements of the cleaning device according to the first exemplary embodiment. In FIGS. 7A through 7F, a right end of the housing portion 12 is enlarged, and a shape of a left end of the housing portion 12 is the same as that of the right end of the housing portion 12.

Figure 7A:
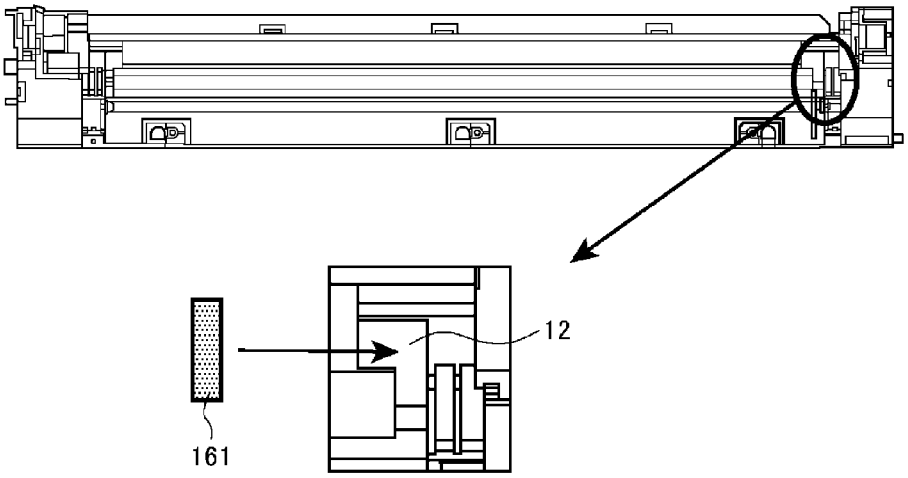
FIG. 7A is a view illustrating a process of manufacturing elements of the cleaning device according to the first exemplary embodiment.
Figure 7B:
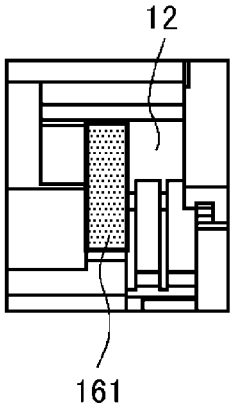
FIG. 7B is a view illustrating the process of manufacturing the elements of the cleaning device according to the first exemplary embodiment.

First, as illustrated in FIG. 7A, the first sealing member 161 is attached to a position in which the right end of the cleaning blade assembly 11 of the housing portion 12 is disposed. Thus, a state of FIG. 7B is established. The first sealing member 161 may be formed of a closed-cell foam sponge that is an elastic member, and has an approximately rectangular parallelepiped shape.

Figure 7C:
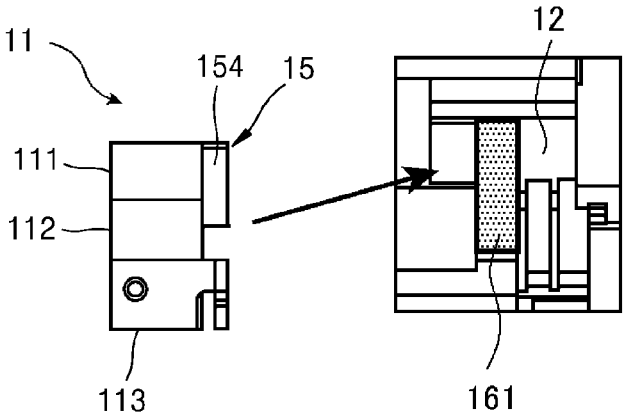
FIG. 7C is a view illustrating the process of manufacturing the elements of the cleaning device according to the first exemplary embodiment.

Subsequently, as illustrated in FIG. 7C, the cleaning blade assembly 11 is mounted on the housing portion 12. Thus, a portion of the first developing agent scattering prevention portion 15 attached to the cleaning blade assembly 11 protrudes from the cleaning blade 111, and overlaps the first sealing member 161. That is, the extension portion 154 of the film member 153 protrudes from the right end 111*b* of the cleaning blade 111, and overlaps the first sealing member 161. The extension portion 154 may be attached to the first sealing member 161.

Figure 7D:
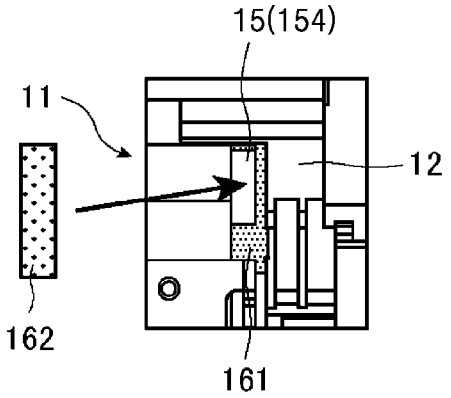
FIG. 7D is a view illustrating the process of manufacturing the elements of the cleaning device according to the first exemplary embodiment.

Subsequently, as illustrated in FIG. 7D, the second sealing member 162 overlaps the extension portion 154 of the first developing agent scattering prevention portion 15 that protrudes from the cleaning blade 111, and the first developing agent scattering prevention portion 15 and the second sealing member 162 are attached to each other at the overlapping portion. The second sealing member 162 may be formed of a closed-cell foam sponge that is an elastic member, and has of an approximately rectangular parallelepiped shape.

Figure 7E:
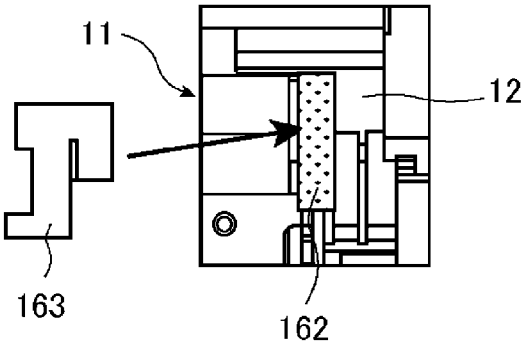
FIG. 7E is a view illustrating the process of manufacturing the elements of the cleaning device according to the first exemplary embodiment.

As illustrated in FIG. 7E, the frictional contact member 163 is disposed on and overlaps the second sealing member 162. Thus, a state of FIG. 7F is established, and a schematic side view thereof is FIG. 6.

Figure 7F:
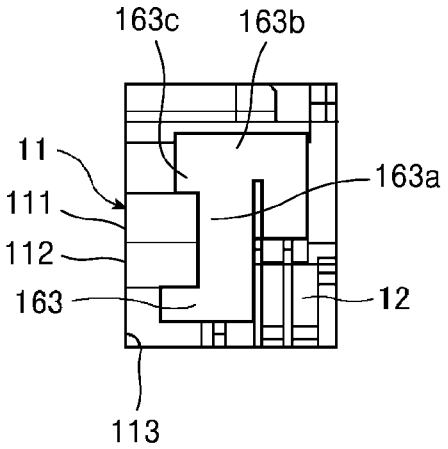
FIG. 7F is a view illustrating the process of manufacturing the elements of the cleaning device according to the first exemplary embodiment.

A contact portion 163*a* of the frictional contact member 163 contacts an outer circumference of the cleaning blade 111, as illustrated in FIG. 7F. Thus, no gap is formed between the frictional contact member 163 and the cleaning blade 111. That is, the cleaning blade 111 and the frictional contact member 163 form "one surface". A portion 163*b* of a top end of the frictional contact member 163 overlaps the upper back film member 17*b*. The photosensitive body 13, the upper back film member 17*b*, and the frictional contact member 163 are disposed from a left side of FIG. 1B, and thereby, the upper back film member 17*b* may be disposed between the photosensitive body 13 and the frictional contact member 163. A portion 163*c* of the frictional contact member 163 that frictionally contacts the photosensitive body 13 is disposed under the overlapping portion 163*b*. Also, the contact portion 163*a* disposed under the portion 163*c* forms "one surface" with the cleaning blade 111, as described above. Thus, sealing characteristics of the closed space 20 formed by the housing portion 12, the photosensitive body 13, the cleaning blade assembly 11, and the back film member 17 may be enhanced.

Figure 7G:
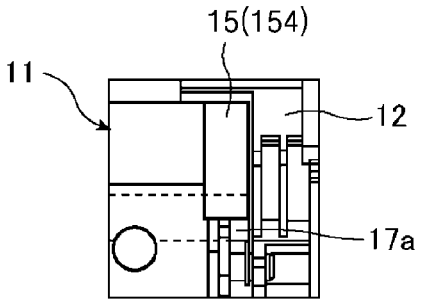
FIG. 7G is a view of a mutual position relationship between the first developing agent scattering prevention portion and a back film member of the cleaning device according to the first exemplary embodiment.

FIG. 7G is a view of a mutual position relationship between the first developing agent scattering prevention portion 15 and the lower back film member 17*a* of the cleaning device according to the first exemplary embodiment.

As illustrated in FIG. 7G, a part of the first developing agent scattering prevention portion 15, for example, a part of the extension portion 154, and a part of the lower back film member 17*a* overlap each other so that sealing characteristics of the closed space 20 may be enhanced.

Subsequently, an effect of preventing the developing agent from leaking from the end of the cleaning blade 111 using the cleaning device according to the first exemplary embodiment will be described with reference to FIGS. 8A through 8D by comparing with examples of related art illustrated in FIGS. 12A through 12C.

Figure 12A:
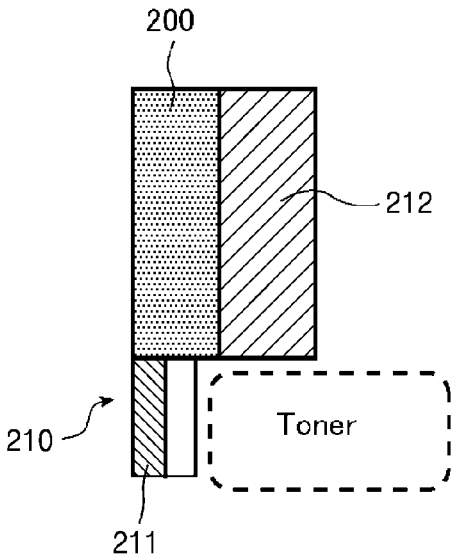
FIG. 12A (RELATED ART)
FIG. 12A is a view illustrating a cleaning device according to related art.
Figure 12B:
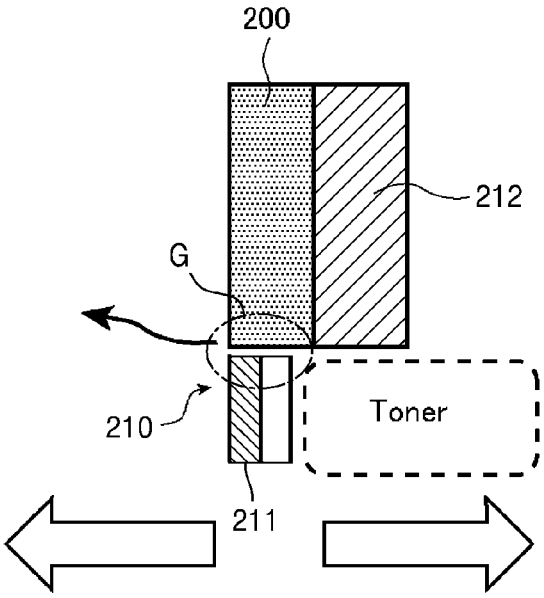
FIG. 12B (RELATED ART)
FIG. 12B is a view illustrating the cleaning device according to the related art.
Figure 12C:
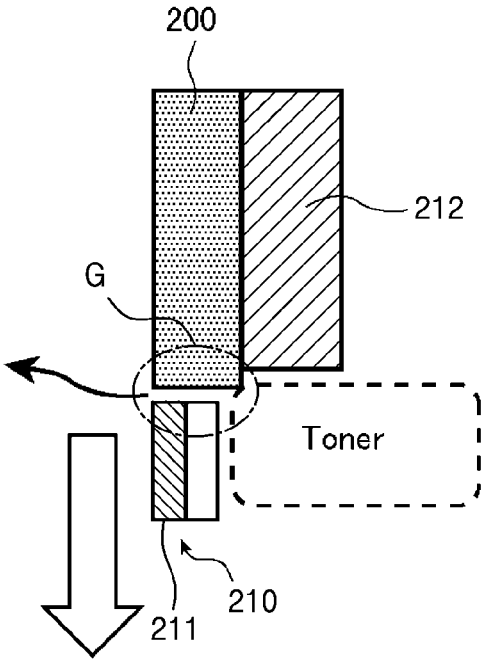
FIG. 12C (RELATED ART)
FIG. 12C is a view illustrating the cleaning device according to the related art.

FIGS. 12A through 12C are views illustrating a cleaning device according to the related art. In detail, FIGS. 12A through 12C are cross-sectional views corresponding cross-sectional views taken along line E-E of FIG. 6, of the cleaning device according to the related art.

As illustrated in FIGS. 12A through 12C, the cleaning device according to the related art has a structure in which a developing agent is prevented from leaking from a space between both ends of a cleaning blade 211 and a housing portion 212. A sealing member 200 having elasticity is installed between ends of a cleaning blade assembly 210 and the housing portion 212 so that a gap between both ends of the cleaning blade 211 and the housing portion 212 may be clogged.

However, the cleaning device according to the related art has a structure in which a lateral end of the sealing member 200 and a lateral end of the cleaning blade assembly 210 contact each other, as illustrated in FIG. 12A. Thus, adhesion performance between the sealing member 200 and the cleaning blade assembly 210 is not so high. Thus, when, in particular, an oscillating-type cleaning blade is employed, the cleaning device according to the related art does not properly respond to oscillation of the cleaning blade 211 and a change of elapsed time so that an effect of preventing leakage of the developing agent may not sufficiently be obtained.

That is, for example, in the cleaning device according to the related art that oscillates in a direction of a diameter of a photosensitive body, as illustrated in FIG. 12B, due to a lowered elastic force caused by deterioration over time of the sealing member 200, a gap G is formed in a contact portion between the lateral end of the sealing member 200 and the lateral end of the cleaning blade assembly 210, and the developing agent may leak through the gap G. Because the sealing member 200 is formed of an elastic member, the sealing member 200 has a pressing force on the elastic cleaning blade assembly 210. However, deformation occurs due to a lowered elastic force caused by repeated usage, i.e., repeated oscillation of the blade 211, so that the gap G illustrated in FIG. 12B is formed.

Also, in the cleaning device according to the related art that oscillates in a direction parallel to an axis of the photosensitive body, as illustrated in FIG. 12C, the gap G is more easily formed. That is, when an elastic force cannot follow the oscillation of the blade 211 or is lowered by deterioration over time of the sealing member 200, the gap G is easily formed, and the developing agent may leak through the gap G.

FIGS. 8A through 8D are views illustrating an effect of the elements of the cleaning device according to the first exemplary embodiment. In detail, FIGS. 8A through 8D are the cross-sectional views taken along the line E-E of FIG. 6.

Figure 8A:
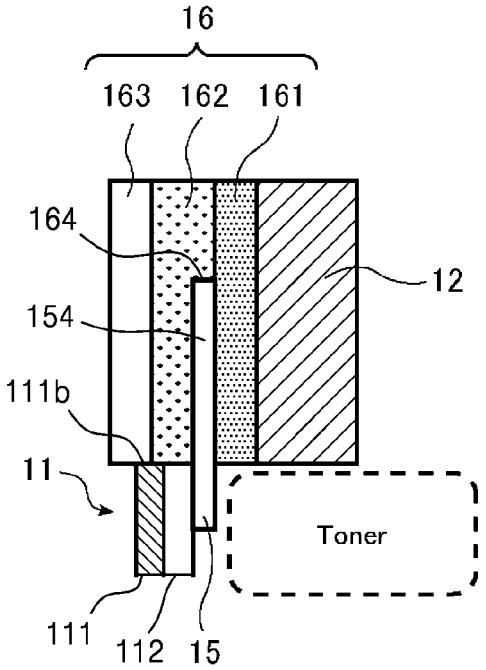
FIG. 8A is a view illustrating an effect of the elements of the cleaning device according to the first exemplary embodiment.

As illustrated in FIG. 8A, the cleaning device according to the first exemplary embodiment has a portion in which the first developing agent scattering prevention portion 15 installed in the cleaning blade assembly 11 and the second developing agent scattering prevention portion 16 installed in the housing portion 12 overlap each other. That is, the cleaning device has a structure in which a part (the extension portion 154) of the first developing agent scattering prevention portion 15 is inserted into a part (the accommodation portion 164) of the second developing agent scattering prevention portion 16. Thus, the developing agent may be effectively prevented from leaking from the end 111*b* of the cleaning blade 111.

Figure 8B:
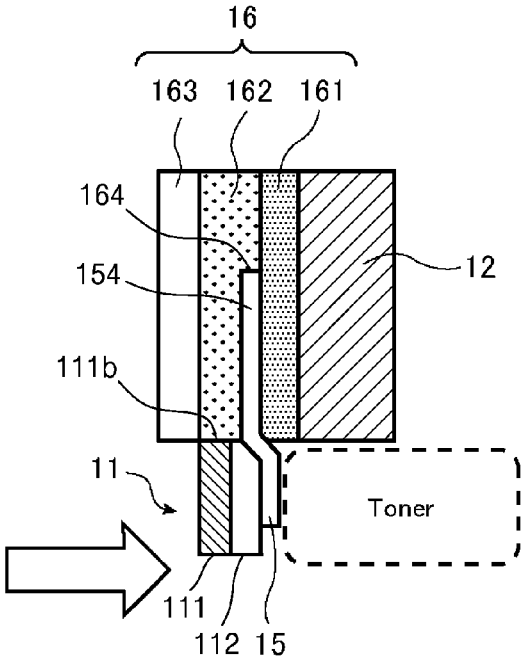
FIG. 8B is a view illustrating the effect of the elements of the cleaning device according to the first exemplary embodiment.
Figure 8C:
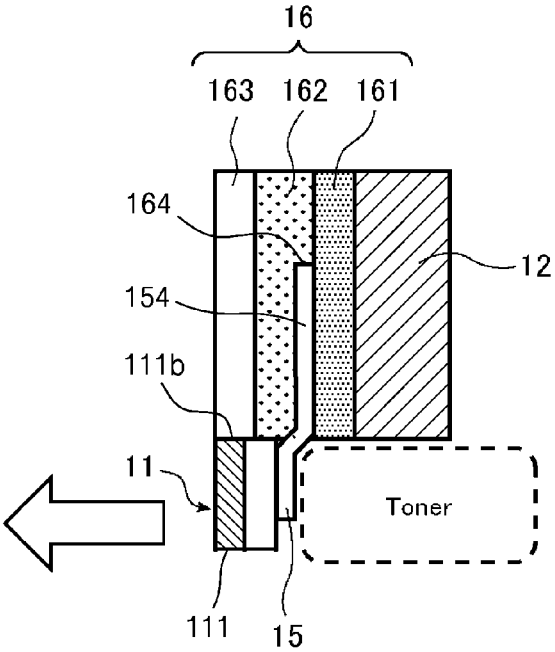
FIG. 8C is a view illustrating the effect of the elements of the cleaning device according to the first exemplary embodiment.

That is, as illustrated in FIGS. 8B and 8C, even when the cleaning blade assembly 11 oscillates in the direction of the diameter of the photosensitive body 13, an occurrence of a gap between the housing portion 12 and the cleaning blade assembly 11 is securely prevented. Thus, even when an elastic force of the first sealing member 161 or the second sealing member 162 is lowered by deterioration over time, an occurrence of a leakage route of the residual developing agent is effectively prevented.

Figure 8D:
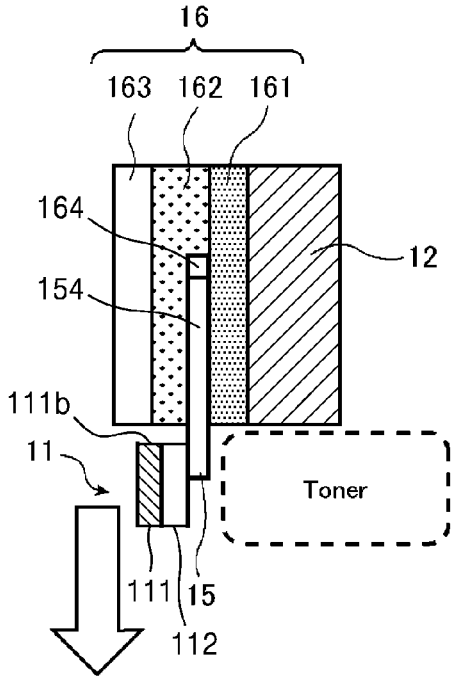
FIG. 8D is a view illustrating the effect of the elements of the cleaning device according to the first exemplary embodiment.

The cleaning device according to the first exemplary embodiment that oscillates in the direction of the diameter of the photosensitive body 13 has been described. However, as illustrated in FIG. 8D, even when the cleaning device oscillates in an axial direction parallel to a rotation axis of the photosensitive body 13, and even when the elastic force of the first sealing member 161 or the second sealing member 162 is lowered by deterioration over time, the occurrence of the leakage route of the residual developing agent is effectively prevented by the first developing agent scattering prevention portion 15. That is, even when a gap is formed between the end 111*b* of the cleaning blade 111 and the second developing agent scattering prevention portion 16, the extension portion 154 clogs the gap so that the occurrence of the leakage route of the residual developing agent is effectively prevented.

As described above, the cleaning device according to the first exemplary embodiment has the portion in which the first developing agent scattering prevention portion 15 installed in the cleaning blade assembly 11 and the second developing agent scattering prevention portion 16 installed in the housing portion 12 overlap each other, and has a structure in which the first developing agent scattering prevention portion 15 is inserted into the second developing agent scattering prevention portion 16. Thus, the cleaning device effectively prevents the developing agent from leaking from the end of the cleaning blade 111.

Referring again to FIG. 1A, the cleaning blade assembly 11 contacts the surface of the photosensitive body 13 using a counter method. The residual developing agent removed by the cleaning blade assembly 11 drops toward a lower side of the drawing.

That is, a large amount of the residual developing agent removed from the photosensitive body 13 remains at a lower position than a contact point F between the photosensitive body 13 and the cleaning blade assembly 11. Thus, measures for preventing leakage of the developing agent need to be further performed. According to the first exemplary embodiment, the first developing agent scattering prevention portion 15 is disposed at a lower position than the contact point F between the photosensitive body 13 and the cleaning blade assembly 11 (in an opposite position to the photosensitive body 13 based on the contact point F).

In the first exemplary embodiment, a structure in which a part of the first developing agent scattering prevention portion 15 is inserted into the accommodation portion 164 of the second developing agent scattering prevention portion 16 has been described. However, exemplary embodiments are not limited thereto.

Figure 9:
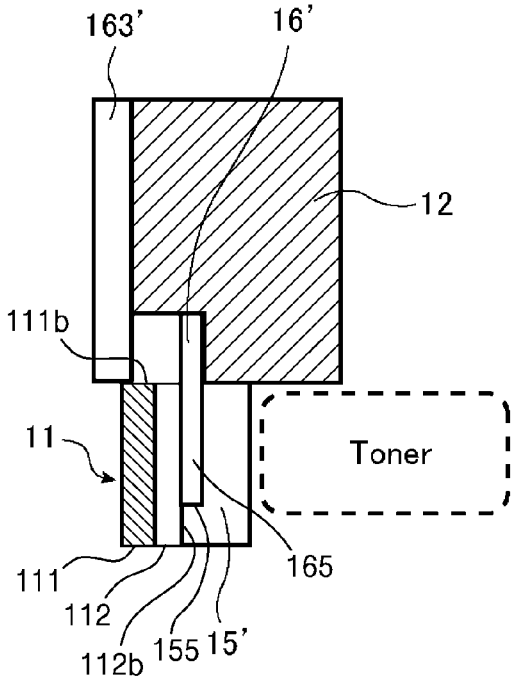
FIG. 9 is a view of a cleaning device according to a second exemplary embodiment.

FIG. 9 is a view of a cleaning device according to a second exemplary embodiment As illustrated in FIG. 9, a structure in which a second developing agent scattering prevention portion 16' installed in the housing portion 12 is inserted into a first developing agent scattering prevention portion 15' installed in the cleaning blade assembly 11, is shown.

In detail, the second developing agent scattering prevention portion 16' is disposed in the housing portion 12. The second developing agent scattering prevention portion 16' includes a film member including an extension portion 165 that extends over the end 111*b* of the cleaning blade 111. Hereinafter, the second developing agent scattering prevention portion 16' is referred to as a film member 16'. The first developing agent scattering prevention portion 15' is attached to the cleaning blade assembly 11. The first developing agent scattering prevention portion 15' includes an elastic member, and an accommodation portion 155 between the elastic member and the support plate 112 and that accommodates the extension portion 165. Hereinafter, the first developing agent scattering prevention portion 15' is referred to as an elastic member 15'.

When the elastic member 15' is attached to the cleaning blade assembly 11, for example, a rear surface 112*b* of the support plate 112, the accommodation portion 155 in which the extension portion 165 of the film member 16' is disposed between the elastic member 15' and the rear surface 112*b*, is formed so that a structure in which a part of the film member 16' is inserted into the elastic member 15' is established. Through this structure, the above-described effects may be achieved.

Also, as illustrated in FIG. 9, a frictional contact member 163' that frictionally contacts the photosensitive body 13 is attached to the housing portion 12.

In the first exemplary embodiment, the film member 153 is attached to the cleaning blade assembly 11 so that the first developing agent scattering prevention portion 15 is formed. However, exemplary embodiments are not limited thereto. For example, the first developing agent scattering prevention portion 15 may also include the extension portion 154 formed by extending a part of an end of the cleaning blade assembly 11, for example, a part of an end of the support plate 112 over the end 111*b* of the cleaning blade 111. That is, the first developing agent scattering prevention portion 15 may also be a part of the cleaning blade assembly 11.

Similarly, for example, in the second exemplary embodiment of FIG. 9, the second developing agent scattering prevention portion 16' may also include the extension portion 165 formed by extending a part of the housing portion 12 over the end 111*b* of the cleaning blade 111. That is, the second developing agent scattering prevention portion 16' may also be a part of the housing portion 12.

Also, in the first exemplary embodiment, the overlapping portion of the first developing agent scattering prevention portion 15 and the first sealing member 161 and the overlapping portion of the first developing agent scattering prevention portion 15 and the second sealing member 162 are attached to each other. However, they may not be attached to each other.

That is, as illustrated in FIGS. 8B through 8D, even when some or all of the overlapping portions are not attached to each other, the cleaning device includes a portion in which the first developing agent scattering prevention portion 15 and the second developing agent scattering prevention portion 16 overlap each other, and has a structure in which the first developing agent scattering prevention portion 15 is inserted into the second developing agent scattering prevention portion 16, so that the occurrence of the leakage route of the residual developing agent may be prevented.

Also, when the overlapping portion of the first developing agent scattering prevention portion 15 and the first sealing member 161 and the overlapping portion of the first developing agent scattering prevention portion 15 and the second sealing member 162 are attached to each other, oscillation of the cleaning blade assembly 11 may be disturbed. However, because each of the first sealing member 161 and the second sealing member 162 is formed of an elastic member, oscillation of the cleaning blade assembly 11 is not disturbed. As illustrated in FIG. 11C according the third exemplary embodiment that will be described later, due to elastic deformation of a sealing member that is an elastic member, the cleaning device may follow an oscillating operation of the cleaning blade assembly 11 without a problem.

In the first exemplary embodiment, the first developing agent scattering prevention portion 15 and the lower back film member 17*a* overlap each other. However, the first developing agent scattering prevention portion 15 or the second developing agent scattering prevention portion 16 and the upper back film member 17*b* may overlap each other.

In the first exemplary embodiment, a sponge has been described as an example of an elastic member that forms the first sealing member 161, the second sealing member 162, and the second sealing member 162. However, exemplary embodiments are not limited thereto, and various materials that may have a predetermined elastic force and may prevent leakage of the developing agent may be used to form the elastic member. Also, in the first exemplary embodiment, a closed-cell foam sponge has been described. Thus, leakage of the developing agent may be effectively prevented. Even when an open-cell foam sponge is used to form the elastic member, the open-cell foam sponge having small bubbles with respect to a diameter of particles of the developing agent to prevent leakage of the developing agent may be used. Exemplary embodiments are not limited to forming small bubbles of the sponge, and after the bubbles are formed, the sponge may be compressed so that the bubbles may be broken.

Also, in the first exemplary embodiment, the cleaning blade 111 contacts the surface of the photosensitive body 13 using the counter method. However, exemplary embodiments are not limited thereto, and other methods may be used.

In a third exemplary embodiment, a developing agent scattering prevention portion that connects the cleaning blade assembly 11 and the housing portion 12 together is installed.

Figure 10:
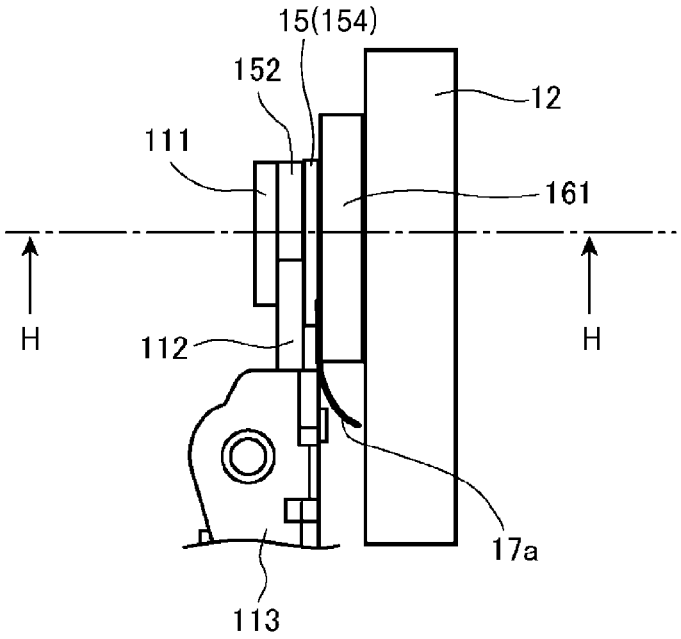
FIG. 10 is a side view of elements of a cleaning device according to a third exemplary embodiment.

FIG. 10 is a side view of elements of a cleaning device according to a third exemplary embodiment. FIG. 10 corresponds to FIG. 6 according to the first exemplary embodiment. As illustrated in FIG. 10, the cleaning device according to the third exemplary embodiment includes the cleaning blade assembly 11 having the first developing agent scattering prevention portion 15 attached to the cleaning blade assembly 11, and the sealing member 161 attached to the housing portion 12, which have the same configuration as the first exemplary embodiment.

The film member 153 of the first developing agent scattering prevention portion 15 includes a portion that overlaps the cleaning blade assembly 11, and simultaneously, includes a portion (the extension portion 154) that overlaps the sealing member 161 attached to the housing portion 12, like in the first exemplary embodiment. Thus, the film member 153 of the first developing agent scattering prevention portion 15 is attached to the cleaning blade assembly 11 and the housing portion 12 by connecting them together. In detail, the attaching portion 151 of the film member 153 is attached to the support plate 112, and the extension portion 154 of the film member 153 is attached to the housing portion 12 or the sealing member 161. In the third exemplary embodiment, the third sealing member 162 and the frictional contact member 163 of the first exemplary embodiment are not disposed.

Figure 11A:
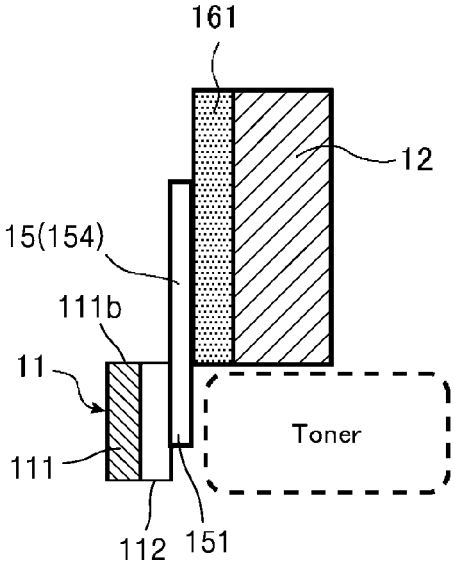
FIG. 11A is a view illustrating an effect of the elements of the cleaning device according to the third exemplary embodiment.
Figure 11B:
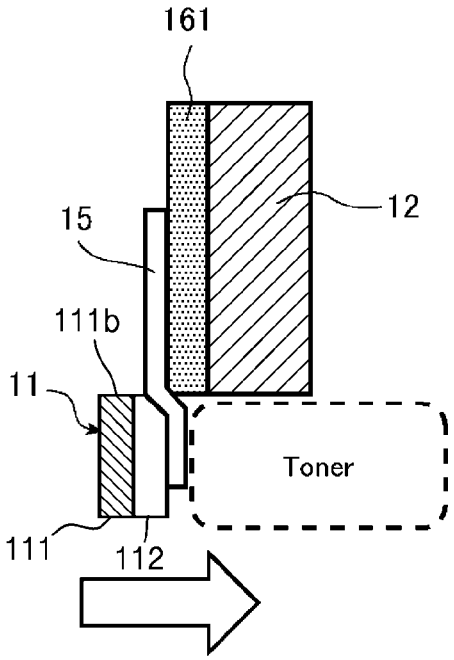
FIG. 11B is a view illustrating the effect of the elements of the cleaning device according to the third exemplary embodiment.
Figure 11C:
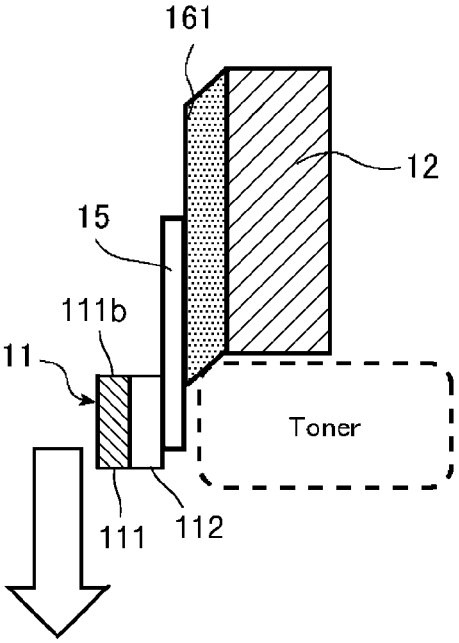
FIG. 11C is a view illustrating the effect of the elements of the cleaning device according to the third exemplary embodiment.

FIGS. 11A through 11C are views illustrating an effect of the elements of the cleaning device according to the third exemplary embodiment. In detail, FIGS. 11A through 11C are cross-sectional views taken along line H-H of FIG. 10, that is, views in which an end of the cleaning blade 111 is viewed from below, illustrating preventing of a developing agent from leaking from the end 111*b* of the cleaning blade 111.

As illustrated in FIG. 11A, the first developing agent scattering prevention portion 15 includes a portion in which the first developing agent scattering prevention portion 15 and the cleaning blade assembly 11 overlap each other and a portion in which the first developing agent scattering prevention portion 15 and the housing portion 12 having the sealing member 161 overlap each other, so that the developing agent is effectively prevented from leaking from the end 111*b* of the cleaning blade 111.

That is, as illustrated in FIG. 11B, even when the cleaning blade assembly 11 oscillates in the direction of the diameter of the photosensitive body 13, an occurrence of a gap between the housing portion 12 and the cleaning blade assembly 11 may be securely prevented. Even when an elastic force of the sealing member 161 is lowered by deterioration over time, an occurrence of a leakage route of the residual developing agent is effectively prevented.

Also, as illustrated in FIG. 11C, even when the cleaning blade assembly 11 oscillates in the axial direction parallel to the rotation axis of the photosensitive body 13, the cleaning device has a structure in which the first developing agent scattering prevention portion 15 overlaps the cleaning blade assembly 11 and the sealing member 161 attached to the housing portion 12. Thus, even when the elastic force of the sealing member 161 is lowered by deterioration over time while responding to the oscillation of the blade 111, the occurrence of the leakage route of the residual developing agent is effectively prevented.

As described above, the cleaning device according to the third exemplary embodiment effectively prevents the developing agent from leaking from the end of the cleaning blade 111.

Figure 13:
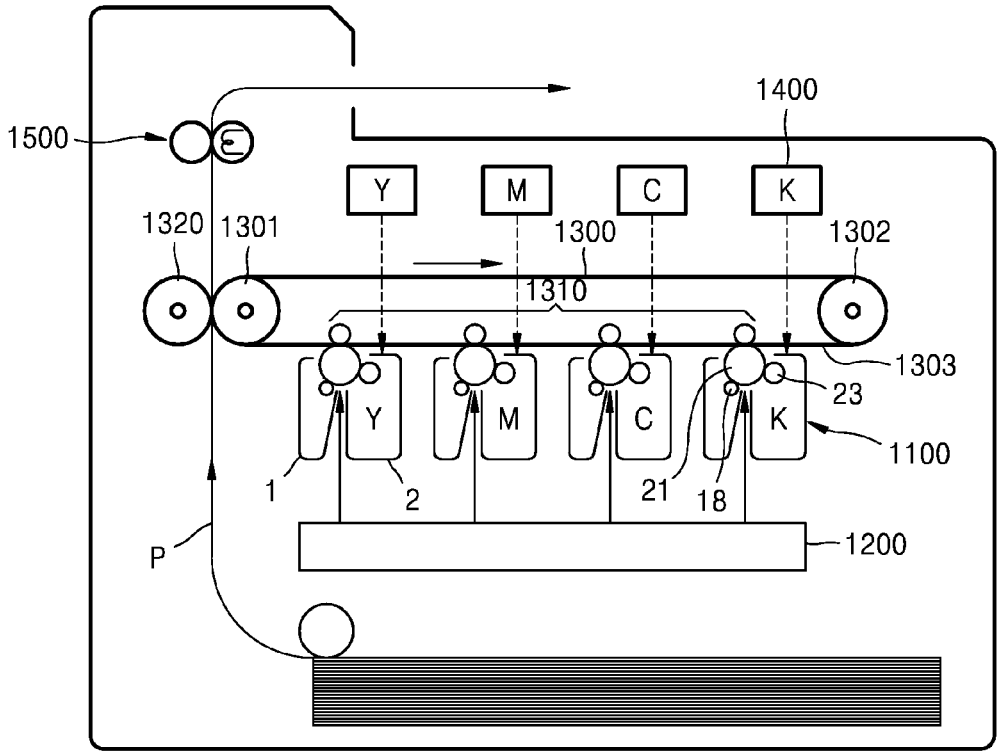
FIG. 13 is a view of a configuration of an image forming apparatus according to an exemplary embodiment.

FIG. 13 is a view of a configuration of an image forming apparatus according to an exemplary embodiment. The image forming apparatus is an electrophotographic color image forming apparatus that forms color images by employing four developing portions 1100 in which toners (developing agents) of cyan (C), magenta (M), yellow (Y) and black (K) colors are respectively accommodated. Hereinafter, C, M, Y, and K are added after reference numerals of members used to form images of C, M, Y, and K colors.

Referring to FIG. 13, the image forming apparatus includes an exposer 1200, the four developing portions 1100, a transferring portion, and a fuser 1500.

Each of the four developing portions 1100 includes the drum portion 1, a developing roller portion 2, a photosensitive drum 21, a charging roller 18, and a developing roller 23. The structure of the drum portion 1 is as described with reference to FIG. 1A, and the drum portion 1 includes the above-described cleaning device. The photosensitive drum 21 is an example of a photosensitive body (e.g., the photosensitive body 13 of FIG. 1B) in which an electrostatic latent image is formed. The photosensitive drum 21 may be a photosensitive drum in which a photosensitive layer having optical conductivity is formed on an outer circumference of a cylindrical metal pipe. The charging roller 18 is a charging device for charging a surface of the photosensitive drum 21 to a uniform electric potential. A corona charging device may also be employed, instead of the charging roller 18.

The exposer 1200 forms an electrostatic latent image by radiating light modulated to correspond to image information onto the photosensitive drum 21. A light-emitting diode (LED) exposer that causes a plurality of LEDs arranged in a main scanning direction to optionally emit light according to the image information may be employed as the exposer 1200. Also, a laser scanning unit (LSU) that deflects light emitted from a laser diode in the main scanning direction using a deflector and scans the light onto the photosensitive drum 1 may be employed as the exposer 1200. The developing roller 23 attaches the toner accommodated in the developing roller portion 2 onto the electrostatic latent image formed on the photosensitive drum 21, thereby developing a toner image. The toner may be accommodated in the developing roller portion 2 and may be supplied to the developing roller portion 2 from a toner container (not shown). The toner container (not shown) may be replaced separately from the developing portions 1100 when all of the toner accommodated in the toner container (not shown) is used up.

The transferring unit transfers the developed toner image on the photosensitive drum 21 onto a recording medium P. The transferring unit transfers the toner image onto the recording medium P via an intermediate transfer belt 1300.

The intermediate transfer belt 1300 that is an intermediate transfer medium onto which the toner image is temporarily transferred before the toner image is finally transferred onto the recording medium P is supported by supporting rollers 1301 and 1302 and circulates thereon. The four developing portions 1100 are disposed in such a way that the photosensitive drum 21 faces a bottom surface 1303 of the intermediate transfer belt 1300. The photosensitive drum 21 contacts the bottom surface 1303 of the intermediate transfer belt 1300. Each of four intermediate transfer rollers 1310 is an example of an intermediate transferring unit for transferring the toner image formed on the photosensitive drum 21 onto the intermediate transfer belt 1300. The four intermediate transfer rollers 1310 are placed to respectively face four photosensitive drums in a state in which the bottom surface 1303 of the intermediate transfer belt 1300 is placed between the four photosensitive drums and the four intermediate transfer rollers 1310. Intermediate transfer bias voltages may be applied to the four intermediate transfer rollers 1310 so that the toner image formed on the photosensitive drum 21 may be transferred onto the intermediate transfer belt 1300. A corona transferring unit may also be employed, instead of the intermediate transfer roller 1310.

A final transfer roller 1320 transfers the toner image on the intermediate transfer belt 1300 onto the recording medium P. A final transfer bias voltage may be applied to the final transfer roller 1320 so that the toner image on the intermediate transfer belt 1300 may be transferred onto the recording medium P. A corona transferring unit may also be employed, instead of the final transfer roller 1320. The fuser 1500 fuses the toner image transferred onto the recording medium P by heating and pressing the toner image.

An operation of forming color images having the above-described configuration will be briefly described.

First, the exposer 1200 forms an electrostatic latent image by radiating light onto a photosensitive drum 21K charged to a uniform electric potential using a charging roller 18K according to image information 1400 of the K color. If a developing bias voltage is applied to a developing roller 23K of a developing portion 1100K, black toner accommodated in the developing portion 1100K is attached as an electrostatic latent image. The black toner image developed on the photosensitive drum 21K due to an intermediate transfer bias voltage applied to an intermediate transfer roller 1310K is transferred onto the intermediate transfer belt 1300. Through the same process, toner images of the C color, the M color, and the Y color are transferred onto the intermediate transfer belt 1300 so that color toner images may be formed on the intermediate transfer belt 1300. The color toner images are transferred onto the recording medium P due to a final transfer bias voltage applied to the final transfer roller 1320, and is fused on the recording medium P using the fuser 1500.

Residual toner that remains on the surface of the photosensitive drum 21 is removed by the above-described cleaning device after the transferring of the developed toner image onto the recording medium P, and is accommodated in the closed space 20.

The foregoing exemplary embodiments and advantages are merely exemplary and are not to be construed as limiting. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A cleaning device configured to remove a developing agent from a photosensitive body, the cleaning device comprising:

a cleaning blade assembly comprising a cleaning blade configured to remove the developing agent, and a support plate configured to support the cleaning blade;

a housing portion configured to support the cleaning blade assembly; and a scattering prevention portion configured to prevent the developing agent from leaking through a gap between an end of the cleaning blade and the housing portion in a lengthwise direction, extend in the lengthwise direction over the end of the cleaning blade, and be attached to the cleaning blade assembly and the housing portion to connect the cleaning blade assembly to the housing portion.

2. The cleaning device of claim 1, wherein the scattering prevention portion comprises a first scattering prevention portion disposed in the cleaning blade assembly, and a second scattering prevention portion disposed in the housing portion, one of the first scattering prevention portion and the second scattering prevention portion comprises an extension portion configured to extend in the lengthwise direction over the end of the cleaning blade, and another one of the first scattering prevention portion and the second scattering prevention portion comprises an accommodation portion configure to accommodate the extension portion.

3. The cleaning device of claim 2, wherein the other one of the first scattering prevention portion and the second scattering prevention portion comprises an elastic member.

4. The cleaning device of claim 2, wherein the first scattering prevention portion comprises a film member, the film member comprising the extension portion configured to extend toward the housing portion over the end of the cleaning blade, and the second scattering prevention portion comprises a first sealing member and a second sealing member configured to overlap each other, and the accommodation portion disposed between the first sealing member and the second sealing member.

5. The cleaning device of claim 4, wherein the extension portion is disposed between the first sealing member and the second sealing member.

6. The cleaning device of claim 4, wherein the second scattering prevention portion comprises a frictional contact member configured to overlap the second sealing member, and frictionally contact the photosensitive body.

7. The cleaning device of claim 4, wherein the cleaning blade is disposed on a first surface of the support plate, and the film member is disposed on a second surface of the support plate that is opposite to the first surface.

8. The cleaning device of claim 7, wherein the first scattering prevention portion comprises an elastic absorption member disposed between the cleaning blade and the film member, the elastic absorption member configured to absorb elasticity of the film member that affects a contact force of the cleaning blade with respect to the photosensitive body.

9. The cleaning device of claim 8, wherein the elastic absorption member is attached to the film member.

10. The cleaning device of claim 2, wherein the second scattering prevention portion comprises a film member, the film member comprising the extension portion configured to extend toward the cleaning blade assembly over the end of the cleaning blade, and the first scattering prevention portion comprises an elastic member attached to the cleaning blade assembly, and the accommodation portion disposed between the cleaning blade assembly and the elastic member.

11. The cleaning device of claim 10, wherein the elastic member is attached to the support plate, and the accommodation portion is disposed between the elastic member and the support plate.

12. The cleaning device of claim 2, wherein the first scattering prevention portion is disposed at a position lower than a contact point between the photosensitive body and the cleaning blade.

13. The cleaning device of claim 1, wherein the scattering prevention portion comprises a film member attached to the cleaning blade assembly, the film member comprising an extension portion configured to extend toward the housing portion over the end of the cleaning blade, and the extension portion is connected to the housing portion.

14. The cleaning device of claim 13, wherein the scattering prevention portion comprises a sealing member attached to the housing portion and the extension portion.

15. The cleaning device of claim 1, wherein the cleaning blade is configured to oscillate in either one or both of a diameter direction of the photosensitive body and an axial direction parallel to a rotation axis of the photosensitive body.

16. An electrophotographic image forming apparatus comprising:

a photosensitive body on which an electrostatic latent image is formed;

a developing portion configured to attach a developing agent onto the electrostatic latent image to develop a toner image;

a transferring portion configured to transfer the toner image onto a recording medium; and a cleaning device configured to remove a developing agent that remains on the photosensitive body after the transferring, wherein the cleaning device comprises a cleaning blade assembly comprising a cleaning blade configured to remove the developing agent, and a support plate configured to support the cleaning blade, a housing portion configured to support the cleaning blade assembly, and a scattering prevention portion configured to prevent the developing agent from leaking through a gap between an end of the cleaning blade and the housing portion in a lengthwise direction, extend in the lengthwise direction over the end of the cleaning blade, and be attached to the cleaning blade assembly and the housing portion to connect the cleaning blade assembly to the housing portion.

17. The electrophotographic image forming apparatus of claim 16, wherein the scattering prevention portion comprises a first scattering prevention portion disposed in the cleaning blade assembly, and a second scattering prevention portion disposed in the housing portion, one of the first scattering prevention portion and the second scattering prevention portion comprises an extension portion configured to extend in the lengthwise direction over the end of the cleaning blade, and another one of the first scattering prevention portion and the second scattering prevention portion comprises an accommodation portion configure to accommodate the extension portion.

18. The electrophotographic image forming apparatus of claim 17, wherein the other one of the first scattering prevention portion and the second scattering prevention portion comprises an elastic member.

19. The electrophotographic image forming apparatus of claim 16, wherein the scattering prevention portion comprises a film member attached to the cleaning blade assembly, the film member comprising an extension portion configured to extend toward the housing portion over the end of the cleaning blade, and the scattering prevention portion comprises a sealing member attached to the housing portion and the extension portion.

20. A cleaning device configured to remove a developing agent from a photosensitive body, the cleaning device comprising:

a blade configured to trace a contour of the photosensitive body to remove the developing agent from the photosensitive body;

a plate disposed on the blade;

a housing; and a film member configured to be attached to the plate and the housing portion to connect the plate to the housing as the blade traces the contour of the photosensitive body.

21. The cleaning device of claim 20, further comprising:

a first elastic member disposed on the housing; and a second elastic member disposed on the first elastic member, wherein the film member is disposed on the plate and between the first elastic member and the second elastic member.

22. The cleaning device of claim 21, further comprising:

a contact member disposed on the second elastic member, the contact member comprising a first portion configured to contact the blade, and a second portion configured to contact the photosensitive body.

23. The cleaning device of claim 20, further comprising:

an elastic member disposed on the plate, wherein the film member is disposed on the housing and between the plate and the elastic member.

24. The cleaning device of claim 23, further comprising:

a contact member disposed on the housing, the contact member configured to contact the photosensitive body.

25. The cleaning device of claim 20, further comprising:

an elastic member disposed on the housing, wherein the film member is disposed between the plate and the elastic member.

* * * * *